US008215487B1

(12) United States Patent
Gess

(10) Patent No.: US 8,215,487 B1
(45) Date of Patent: Jul. 10, 2012

(54) INFLATABLE PACKAGING WITH SELF-SEALING AIR BUBBLES

(76) Inventor: Larry C. Gess, Palmyra, WI (US)

( * ) Notice: Subject to any disclaimer, the term of this patent is extended or adjusted under 35 U.S.C. 154(b) by 0 days.

(21) Appl. No.: 13/282,592

(22) Filed: Oct. 27, 2011

Related U.S. Application Data

(60) Provisional application No. 61/408,590, filed on Oct. 30, 2010.

(51) Int. Cl.
*B65D 81/02* (2006.01)

(52) U.S. Cl. ..... 206/522

(58) Field of Classification Search ..... 206/522
See application file for complete search history.

(56) References Cited

U.S. PATENT DOCUMENTS 5,427,830 A 6/1995 Pharo
7,694,701 B2 4/2010 Koyanagi
2003/0094394 A1* 5/2003 Anderson et al. ..... 206/522
2003/0094395 A1* 5/2003 Peper et al. ..... 206/522
2005/0247592 A1* 11/2005 Peper et al. ..... 206/522
2006/0210773 A1* 9/2006 Kannankeril ..... 428/166
2007/0170084 A1* 7/2007 Chen et al. ..... 206/522
2008/0197041 A1* 8/2008 Jian ..... 206/522
2009/0050509 A1* 2/2009 Liao et al. ..... 206/522
2010/0072103 A1* 3/2010 Watanabe et al. ..... 206/522

* cited by examiner

*Primary Examiner* — Jacob K Ackun
(74) *Attorney, Agent, or Firm* — Donald J. Ersler

(57) ABSTRACT

Inflatable packaging with self-sealing air bubbles includes a bubble layer, a valve layer and a valve cover layer. A plurality of bubble cell patterns are formed on the bubble layer with adhesive, glue or heat sealing. The valve layer is attached to bubble layer. A plurality of check valves are formed on the valve layer. An air opening is formed through each one of the plurality of check valves to inflate the plurality of bubble cells. The valve cover layer is attached to the valve layer. A row with at least one bubble cell is filled with air through the check valve. Inflation of the bubble cells cause the valve layer and valve cover layer to contact each other to seal the check valve.

19 Claims, 6 Drawing Sheets

INFLATABLE PACKAGING WITH SELF-SEALING AIR BUBBLES

CROSS-REFERENCES TO RELATED APPLICATIONS

This is a nonprovisional patent application taking priority from provisional application No. 61/408,590 filed on Oct. 30, 2010.

BACKGROUND OF THE INVENTION

1. Field of the Invention

The present invention relates generally to protective packaging and more specifically to inflatable packaging with self-sealing air bubbles, which does not require sealing after inflation or a complex inflation apparatus.

2. Discussion of the Prior Art

It is well known in the art of inflatable packaging to fill multiple compartments with air and then seal the multiple compartments to retain the air therein. However, the inflatable packaging is typically complicated or the machinery used to produce the inflatable packaging with air is also complicated. Complicated inflatable packaging will require complicated machinery to fill thereof. A complicated inflatable packaging machine will not always produce a consistent product, due to the complexity of the machine and also variations in the sheet material used to produce the inflatable packaging.

Typically, a manufacturer of inflatable packaging provides a customer with inflatable packaging machines at no cost and sells the inflatable packaging to the customer. Any problems with the inflatable packaging machines is the manufacturer's responsibility and expense. It is to the manufacturer's advantage to have the simplest and most inexpensive inflatable packaging machines to produce the inflatable packaging. Having inexpensive inflatable packaging machinery makes it possible to sell the inflatable packaging to smaller companies.

U.S. Pat. No. 5,427,830 to Pharo discloses a continuous, inflatable plastic wrapping material. U.S. Pat. No. 7,694,701 to Koyanagi discloses a structure or check valve for air-packing device.

Accordingly, there is a clearly felt need in the art for inflatable packaging with self-sealing air bubbles, which does not require sealing after inflation or a complex inflation apparatus.

SUMMARY OF THE INVENTION

The present invention provides inflatable packaging with self-sealing air bubbles, which does not require sealing after inflation or a complex inflation apparatus. The inflatable packaging with self-sealing air bubbles (inflatable bubble packaging) includes a bubble layer, a valve layer and a valve cover layer. If a substance is used to form a plurality of bubble cells, a bubble cell pattern is printed on a top of the bubble layer. Otherwise, at least one heat sealing roller has the plurality of bubble cells formed thereupon. If a substance is used to form a plurality of check valves, a check valve pattern is printed on a top of the valve layer. Otherwise, at least one heat sealing roller has the plurality of check valves formed thereupon. An air opening is formed through each one of the plurality of check valves adjacent a closed end of the check valve to provide air flow from the check valve to at least one bubble cell in a row.

The valve layer is either adhesively attached or heat sealed to the bubble layer to form the plurality of bubble cells. The valve cover layer is adhesively attached or heat sealed to the valve layer to form the plurality of check valves. A row with at least one bubble cell is filled with air by applying a source of air at an open end of the check valve. The air travels through the air opening into the at least one bubble cell. Inflation of the at least one bubble cell causes the valve layer and valve cover layer to contact each other to seal the check valve to prevent air from escaping the at least one bubble cell. To further prevent air from escaping the at least one bubble cell, a clinging substance may be applied to an inside surface of at least one of the valve layer and the valve cover layer inside the check valve. The clinging substance causes the valve layer to cling to the valve cover layer and thus further help prevent air from escaping the at least one bubble cell through the check valve.

An apparatus for inflating a strip of self-sealing air bubbles (inflation apparatus) preferably includes an apparatus frame, at least one guide roller, a guide rail, an inflation pin and a pair of pinch rollers. The apparatus frame includes a first support wall, a second support wall, a base support and a top support panel. The first support wall is attached to a first end of the base support and the top support panel and the second support wall is attached to a second end of the base support and the top support panel. The at least one guide roller provides support for feeding the continuous strip into the guide rail. A strip guide includes a semi-circular inner perimeter, which is concentric with a top guide roller. The continuous strip is pulled through the guide rail.

The inflation pin is inserted into an end of the continuous strip, between the valve layer and the valve cover layer. The continuous strip is pulled and inserted between the pair of pinch rollers. The pinch rollers are rotated with a motor. The inflation pin includes an inflation opening. An air compressor is connected to the inflation tube, such that compressed air flows through the inflation opening. The pinch rollers are rotated by the motor and the source of compressed air is activated to inflate the plurality of bubble cells in the continuous strip.

Accordingly, it is an object of the present invention to provide inflatable packaging with self-sealing air bubbles, which does not require sealing after inflation.

Finally, it is another object of the present invention to provide inflatable packaging with self-sealing air bubbles, which does not require a complex inflation apparatus.

These and additional objects, advantages, features and benefits of the present invention will become apparent from the following specification.

DETAILED DESCRIPTION OF THE PREFERRED EMBODIMENTS

Figure 1:
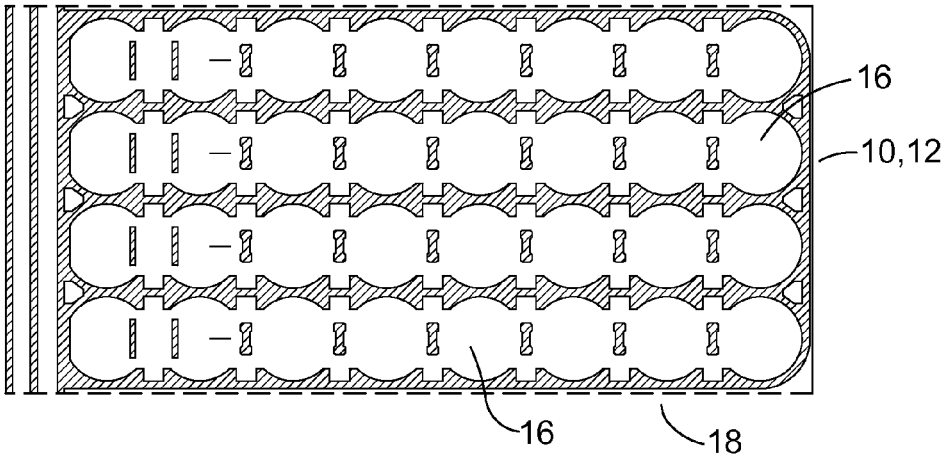
FIG. 1 is a top view of a valve layer attached to a bubble layer of inflatable bubble packaging in accordance with the present invention.
Figure 2:
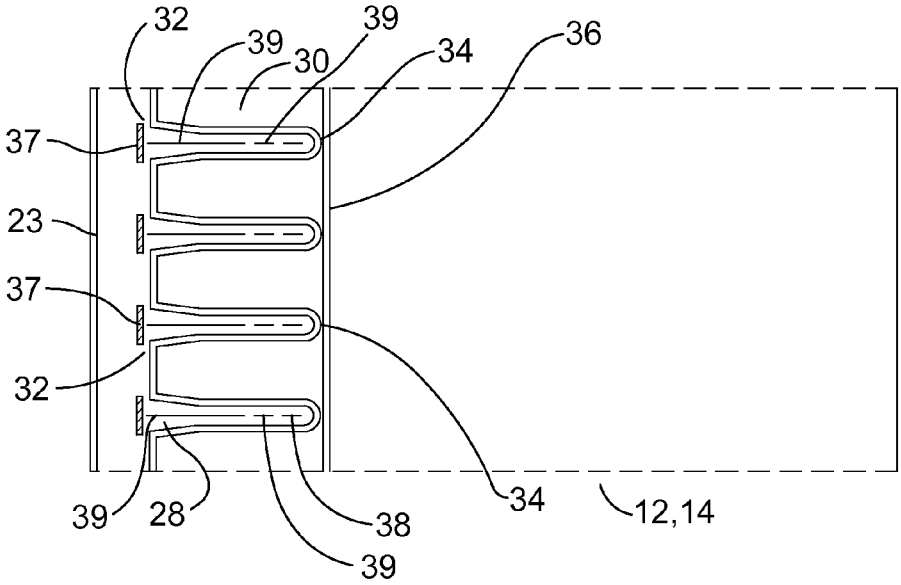
FIG. 2 is a top view of a valve cover layer attached to a valve layer of inflatable bubble packaging in accordance with the present invention.
Figure 3:
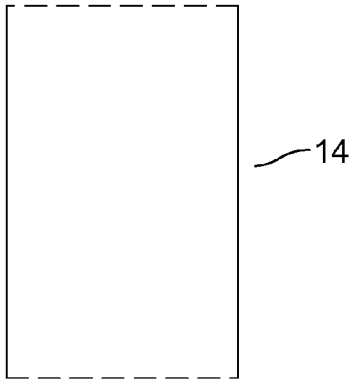
FIG. 3 is a top view of a valve cover layer of inflatable bubble packaging in accordance with the present invention.
Figure 4:
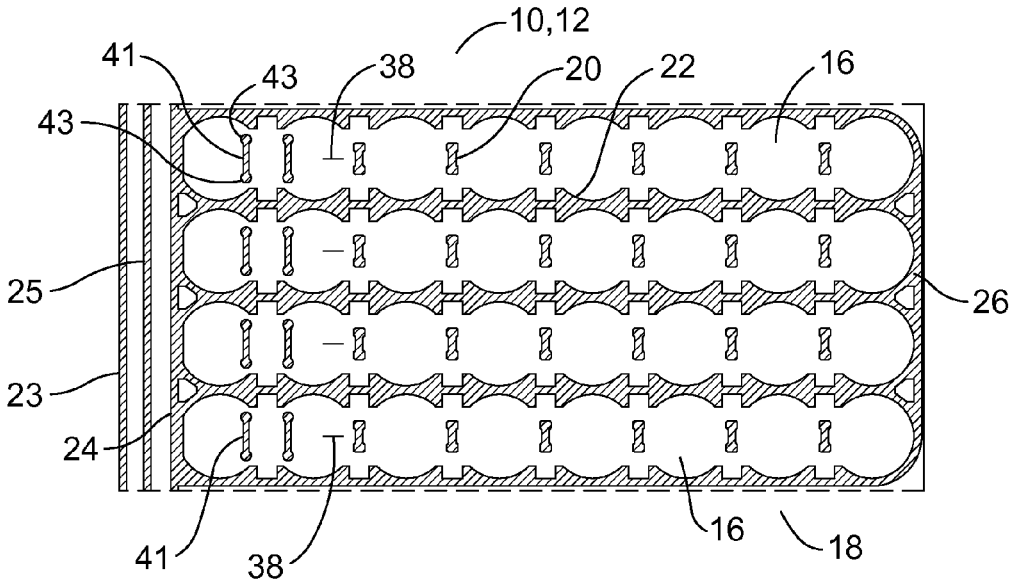
FIG. 4 is an enlarged top view of a valve layer attached to a bubble layer of inflatable bubble packaging in accordance with the present invention.
Figure 5:
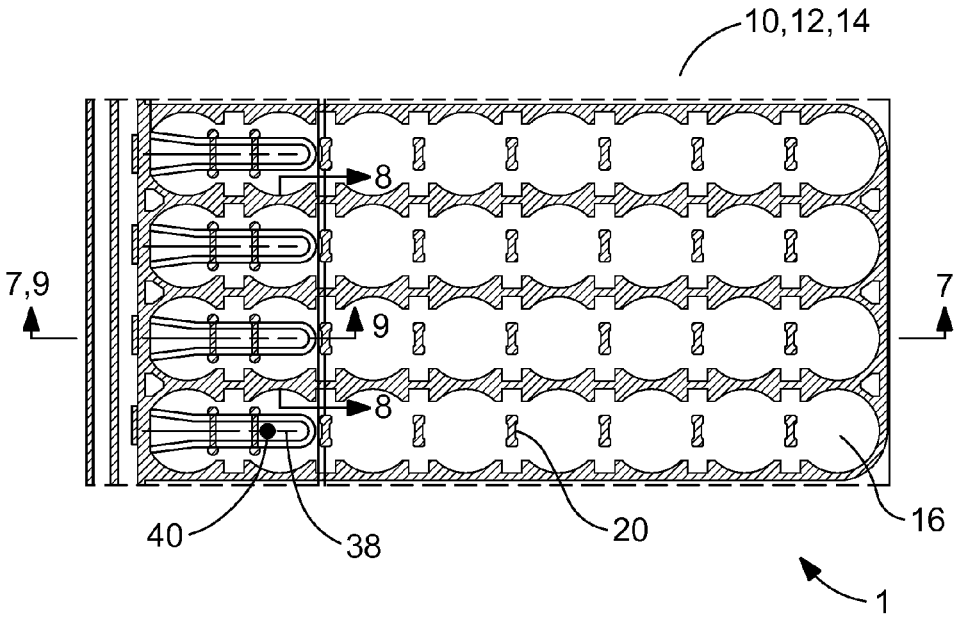
FIG. 5 is a top view of an assembled inflatable bubble package in accordance with the present invention.
Figure 6:
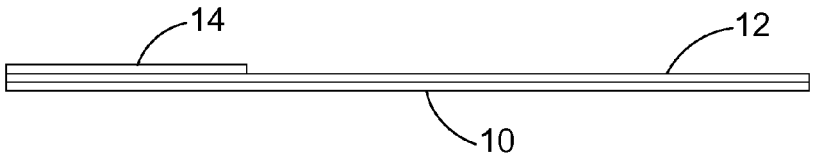
FIG. 6 is an end view of an assembled inflatable bubble package in accordance with the present invention.

With reference now to the drawings, and particularly to FIG. 5, there is shown a top view of assembled inflatable bubble packaging 1. With reference to FIGS. 1-4 and 6, the inflatable bubble packaging 1 includes a bubble layer 10, a valve layer 12 and a valve cover layer 14. If a substance is used to form a plurality of bubble cells 16 on the bubble layer 10, a bubble cell pattern 18 is printed an inside surface of the bubble layer 10. The bubble cell pattern 18 includes a plurality of bubble end perimeter portions 20, a plurality of bubble side perimeters 22, a first end portion 24 and a second end portion 26.

The bubble layer 10 is sealed to the valve layer 12 at a first edge sealing line 23 thereof. An air channel seal line 25 is preferably formed between the first edge sealing line 23 and the input end portion 24. The substance is preferably an ultraviolet cured adhesive, but other substances, such as adhesive, glue or an ultraviolet cured glue may also be used. The valve layer 12 is secured to the bubble layer 10 to form the bubble cell pattern 18. Otherwise, at least one bubble heat sealing roller has a raised heat sealing surface that has the same pattern shape as the bubble cell pattern 18 to heat seal the valve layer 12 to the bubble layer 10.

If a substance is used to form a plurality of check valves 28 on the valve layer 12, then a check valve pattern 30 having a continuous line is printed on a top surface of the valve layer 12. The check valve pattern 30 includes a plurality of input entrances 32 on one end and a plurality of closed areas 34 on the other end. The check valve pattern 30 further preferably includes an entrance sealing line 37 and at least one inner valve sealing line 39. A valve sealing line 36 is formed adjacent the plurality of closed areas 34 to seal the valve cover layer 14 to the valve layer 12. An air opening 38 is formed through the valve layer 12, adjacent the closed area 34 to allow air to pass through the check valve 28 to the at least one bubble cell 16. The air opening 38 is preferably a slit, but could be any other type of opening. The valve cover layer 14 is secured to the valve layer 12 with the check valve pattern 30, the sealing line 36 and the first edge sealing line 23. Otherwise, at least one heat sealing roller has a raised heat sealing surface that has the same pattern shape as the check valve pattern 30, the sealing line 36 and the first edge sealing line 23 to heat seal the valve cover layer 14 to the valve layer 12.

Figure 7:
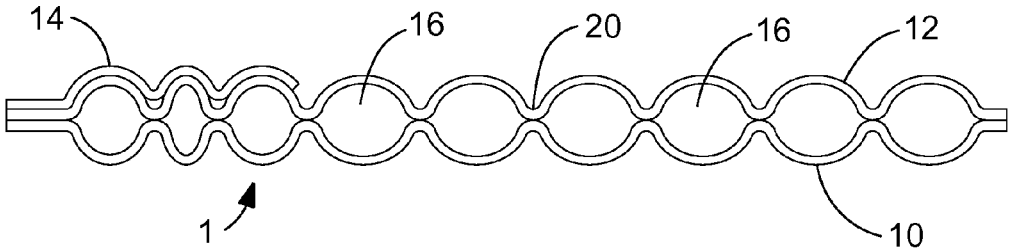
FIG. 7 is a cross sectional view of an inflatable bubble package filled with air in accordance with the present invention.

With reference to FIG. 7, each row of bubble cells 16 are filled with air by applying a source of pressurized air at the input entrance 32 of a particular row of bubble cells 16. Air pressure inflates each bubble cell 16. Air flows past the entrance sealing line 37; around the at least one inner valve sealing line 39; through the air opening 38 in the valve layer 12; around each end of a plurality of bubble end perimeter portions 20, until air fills the last bubble cell 16. Successive bubble cells 16 are filled with air, until all bubble cells 16 are filled with air.

Figure 8:
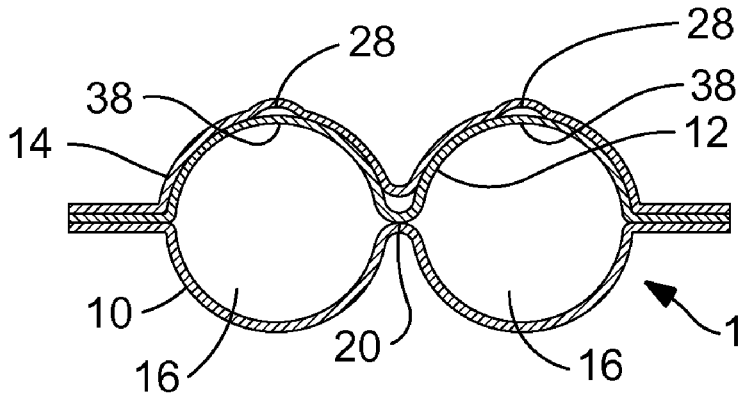
FIG. 8 is an enlarged cross sectional view of a portion of an inflatable bubble package cut through FIG. 5 during inflation in accordance with the present invention.
Figure 9:
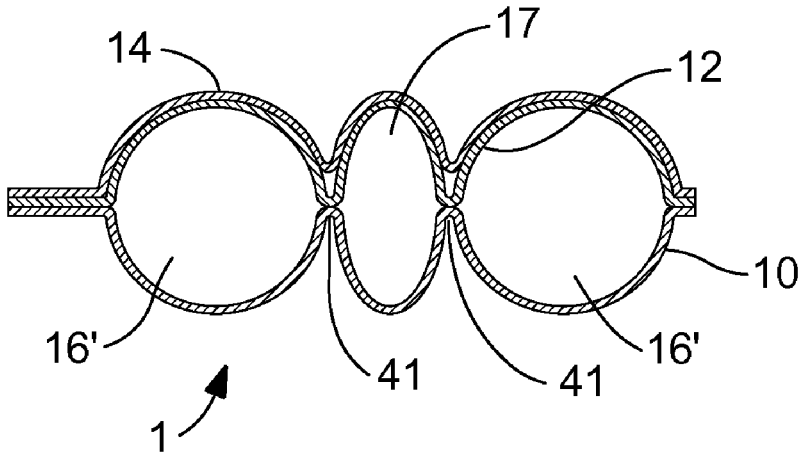
FIG. 9 is an enlarged cross sectional view of a portion of an inflatable bubble package cut through FIG. 5, which is filled with air in accordance with the present invention.

With reference to FIG. 8, air travels through the check valve 28, through the air opening 38 into the second bubble cell 16 of the row of bubble cells 16. As the bubble cells 16 inflate, upward pressure is exerted by the valve layer 12 against the valve cover layer 14. With reference to FIG. 9, when the flow of pressurized air ceases, preferably two air flow sealing lines 41 force the valve cover layer 14 to contact the valve layer 12 and seal the check valve 28, such that air cannot flow back out-of the check valve 28 through the input entrance 32. The two air flow sealing lines 41 are formed between first and second bubble cells 16 in the row of bubble cells 16. Each end of the air flow sealing line 41 is preferably terminated with air flow dot 43 to prevent tearing of the continuous strip 1. The two air flow sealing lines 41 create two reduced bubble cells 16' and a middle bubble cell 17. The bubble layer 10, valve layer 12 and the valve cover layer 14 are fabricated from transparent plastic sheet material that must be stretchable to allow the plurality of inflated bubble cells 16 to be formed.

It is preferable to have the air opening 38 located over the second bubble cell 16 to provide more sealing area in the check valve 28. Further, increased sealing integrity may be achieved by locating the air opening 38 over a last bubble cell 16. However, the air opening 38 could also be located over the first bubble cell 16. The row of bubble cells 16 may include only a single bubble cell 16 or as many bubble cells 16 as can be practically inflated. The number of rows of bubble cells 16 that may be formed is limited only by the width of plastic sheet.

With reference to FIG. 5, a clinging substance 40 is preferably located in the check valve 28. The clinging substance 40 is applied to an inside surface of at least one of the valve layer 12 and the valve cover layer 14. The clinging substance may also be applied around the air opening 38. The clinging substance 40 causes the valve layer 12 to cling to the valve cover layer 14 and thus provide additional protection from air escaping the at least one bubble cell 16 through the check valve 28. The clinging substance 40 may be any appropriate substance that can be cured or allowed to dry to produce a tacky surface, such as ultraviolet curing adhesive.

Figure 10:
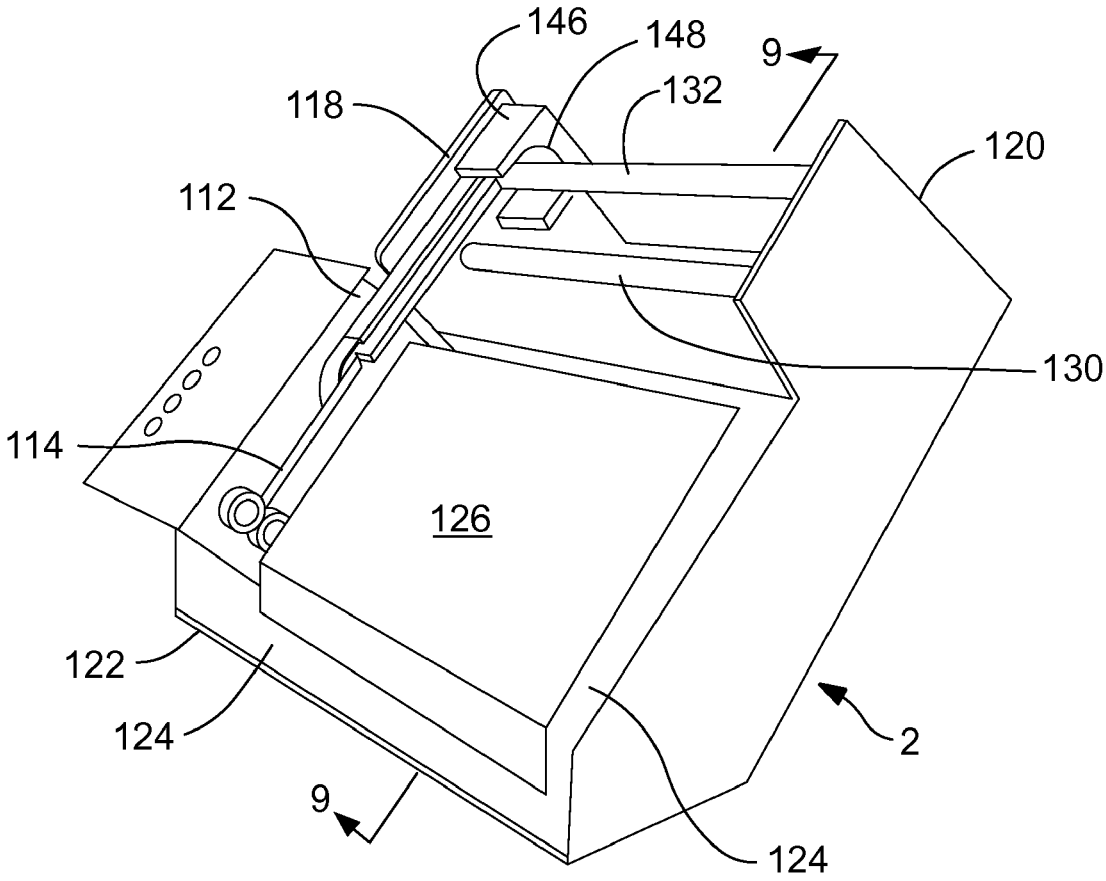
FIG. 10 is a perspective view of an apparatus for inflating a continuous strip of self-sealing inflatable air bubbles in accordance with the present invention.
Figure 11:
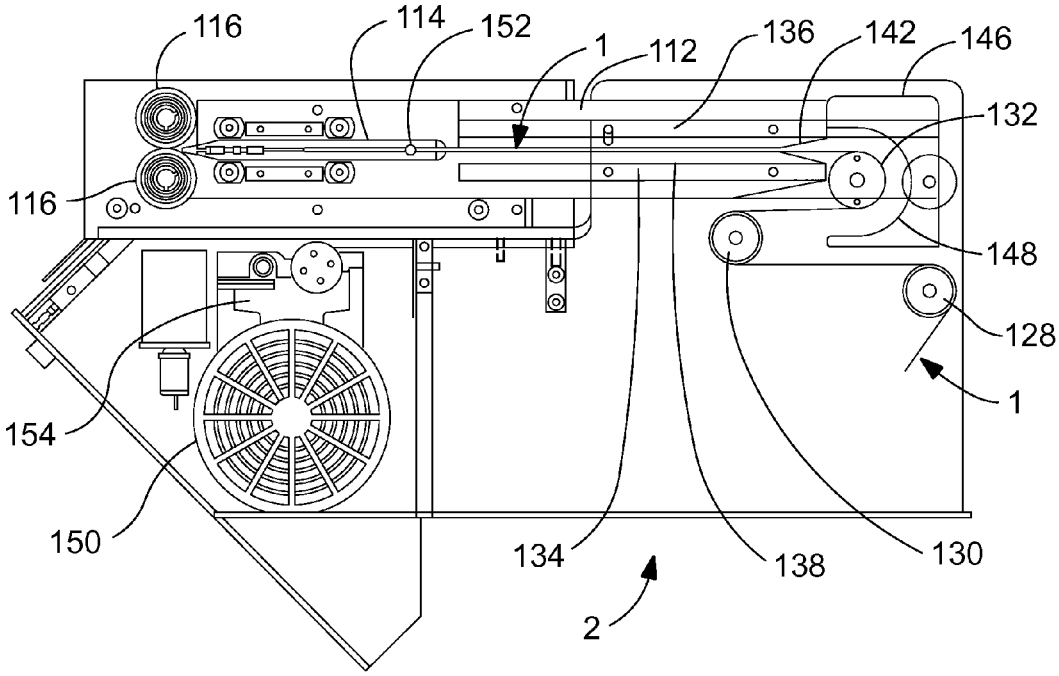
FIG. 11 is a cross-sectional view of an apparatus for inflating a strip of self-sealing inflatable air bubbles cut through FIG. 10 in accordance with the present invention.

With reference to FIGS. 10-11, an inflation apparatus 2 includes an apparatus frame 110, at least one guide roller, a guide rail 112, an inflation pin 114 and a pair of pinch rollers 116. The apparatus frame 110 includes a first support wall 118, a second support wall 120, a base support 122 and a top support panel 124. The first support wall 118 is attached to a first end of the base support 122 and the top support panel 124 and the second support wall 120 is attached to a second end of the base support 122 and the top support panel 124. A film support panel 126 is preferably attached to a top of the top support panel 124. A first guide roller 128, a second guide roller 130 and a third guide roller 132 are retained between the first and second support walls. The first, second and third guide rollers provide support for feeding the continuous strip 1 into the guide rail 112.

The guide rail 112 includes a lower guide member 134 and an upper guide member 136. A gap 138 is maintained between the lower and upper guide members to provide clearance for the continuous strip 1. An entrance to the lower guide member 134 includes a lower entrance chamfer 140 and an entrance to the upper guide member 136 includes an upper entrance chamfer 142. A strip guide 146 includes a semi-circular inner perimeter 148, which is concentric with the third guide roller 132 to provide feeding guidance to the continuous strip 1.

An end of the continuous strip 1 is pulled over the inflation pin 114, such that the inflation pin 114 is inserted between the valve layer 12 and the cover valve layer 14; and between the first edge 38 of the air channel layer 14 and the plurality of entrance sealing lines 37 and the first edge sealing line 23 of the valve layer 12. The continuous strip 1 is pulled and inserted between the pair of pinch rollers 116. The pinch rollers 116 are rotated with a motor 150, which pulls the continuous strip 1 through the inflation apparatus 2. The inflation pin 114 includes at least one inflation opening 152. An air compressor 154 is driven by the motor 150. An output of the air compressor 154 is connected to the inflation tube 114, such that compressed air flows through the inflation opening 152. The pinch rollers 116 are rotated by the motor 150 and the air compressor 154 is activated to inflate the plurality of bubble cells 16 in the continuous strip 1 through the plurality of air passages 52.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An inflatable packaging with self-sealing air bubbles, comprising:

a bubble layer;

a valve layer is attached to said bubble layer to form a plurality of bubble cell patterns, each one of said plurality of bubble cell patterns includes a plurality of bubble cells in a row, two air flow sealing lines are formed between first and second bubbles cells in one of said bubble cell patterns, said bubble layer and said valve layer are attached to each other in the area of said two air flow sealing lines; and a valve cover layer is attached to said valve layer to form a plurality of check valves, an air opening is formed through each one of said plurality of check valves to communicate with at least one of said plurality of bubble cells, wherein at least one of said plurality of bubble cells is filled with air through one of said plurality of check valves.

2. The inflatable packaging with self-sealing air bubbles of claim 1 wherein:

at least one of said plurality of bubble cell patterns includes a plurality of bubble end perimeter portions, a plurality of bubble side perimeters, a first end portion and a second end portion.

3. The inflatable packaging with self-sealing air bubbles of claim 1 wherein:

said plurality of bubble cell patterns are created by printing one of an adhesive, an ultraviolet cured adhesive and an ultraviolet cured glue.

4. The inflatable packaging with self-sealing air bubbles of claim 1 wherein:

said plurality of bubble cell patterns are created on at least one heat sealing roller.

5. The inflatable packaging with self-sealing air bubbles of claim 1 wherein:

a check valve pattern is formed on said valve layer, said check valve pattern includes said plurality of check valves.

6. The inflatable packaging with self-sealing air bubbles of claim 5 wherein:

said check valve pattern is created by printing one of an adhesive, an ultraviolet cured adhesive and an ultraviolet cured glue.

7. The inflatable packaging with self-sealing air bubbles of claim 5 wherein:

said check valve pattern is created on at least one heat sealing roller.

8. The inflatable packaging with self-sealing air bubbles of claim 1 wherein:

a clinging substance is located in each one of said plurality of check valves.

9. The inflatable packaging with self-sealing air bubbles of claim 1, further comprising:

an air flow dot terminates each end of each one of said two air flow sealing lines, said bubble layer and said valve layer being attached to each other in the area of said air flow dot.

10. An inflatable packaging with self-sealing air bubbles, comprising:

a bubble layer;

a valve layer is attached to said bubble layer to form a plurality of bubble cell patterns, each one of said plurality of bubble cell patterns includes a plurality of bubble cells; and a valve cover layer is attached to said valve layer to form a plurality of check valves, an entrance sealing line is formed across an input end of at least one of said plurality of check valves, said bubble layer and said valve layer are attached to each other in the area of said entrance sealing line, said entrance sealing line creates two entrances to one of said plurality of said check valves, each entrance is smaller than a width of said check valve, an air opening is formed through each one of said plurality of check valves to communicate with at least one of said plurality of bubble cells, wherein at least one of said plurality of bubble cells is filled with air through one of said plurality of check valves.

11. The inflatable packaging with self-sealing air bubbles of claim 10 wherein:

at least one of said plurality of bubble cell patterns includes a plurality of bubble end perimeter portions, a plurality of bubble side perimeters, a first end portion and a second end portion.

12. The inflatable packaging with self-sealing air bubbles of claim 10 wherein:

said plurality of bubble cell patterns are created by printing one of an adhesive, an ultraviolet cured adhesive and an ultraviolet cured glue.

13. The inflatable packaging with self-sealing air bubbles of claim 10 wherein:

a check valve pattern is formed on said valve layer, said check valve pattern includes said plurality of check valves.

14. The inflatable packaging with self-sealing air bubbles of claim 10 wherein:

a clinging substance is located in each one of said plurality of check valves.

15. An inflatable packaging with self-sealing air bubbles, comprising:

a bubble layer;

a valve layer is attached to said bubble layer to form a plurality of bubble cell patterns, each one of said plurality of bubble cell patterns includes a plurality of bubble cells;

a valve cover layer is attached to said valve layer to form a plurality of check valves, at least one inner valve sealing line is formed inside at least one of said plurality of check valves, said at least one inner valve sealing line extends substantially all of a length of at least one of said plurality of check valves, said valve cover layer and said valve layer are attached to each other in the area of said at least one inner valve sealing line, an air opening is formed through each one of said plurality of check valves to communicate with at least one of said plurality of bubble cells, wherein at least one of said plurality of bubble cells is filled with air through one of said plurality of check valves.

16. The inflatable packaging with self-sealing air bubbles of claim 15 wherein:

at least one of said plurality of bubble cell patterns includes a plurality of bubble end perimeter portions, a plurality of bubble side perimeters, a first end portion and a second end portion.

17. The inflatable packaging with self-sealing air bubbles of claim 15 wherein:

said plurality of bubble cell patterns are created by printing one of an adhesive, an ultraviolet cured adhesive and an ultraviolet cured glue.

18. The inflatable packaging with self-sealing air bubbles of claim 15 wherein:

a check valve pattern is formed on said valve layer, said check valve pattern includes said plurality of check valves.

19. The inflatable packaging with self-sealing air bubbles of claim 15 wherein:

a clinging substance is located in each one of said plurality of check valves.

* * * * *